US006057019A

United States Patent [19]

Barry

[11] Patent Number: 6,057,019

[45] Date of Patent: May 2, 2000

[54] LABELS

[75] Inventor: David Robert Barry, St. Louis, Mo.

[73] Assignee: Inprint Systems Inc., St. Charles, Mo.

[21] Appl. No.: 09/102,011

[22] Filed: Jun. 22, 1998

[51] Int. Cl.[7] ..... G09F 3/00

[52] U.S. Cl. ..... 428/40.1; 281/2; 281/5; 283/81; 428/41.7; 428/41.8; 428/42.1; 428/42.2; 428/42.3; 428/121

[58] Field of Search ..... 428/40.1, 41.7, 428/41.8, 42.1, 42.2, 42.3, 43, 121; 283/81; 281/2, 5

[56] References Cited

U.S. PATENT DOCUMENTS

| | | | |
|---|---|---|---|
| 4,621,442 | 11/1986 | Mack | 428/40.1 |
| 5,399,403 | 3/1995 | Instance | 428/40.1 |
| 5,830,550 | 11/1998 | Treleaven | 428/40.1 |

FOREIGN PATENT DOCUMENTS

| | | |
|---|---|---|
| 0833295 | 9/1997 | European Pat. Off. . |
| 2220886 | 1/1990 | United Kingdom . |
| WO07132 | 2/1998 | WIPO . |

*Primary Examiner*—Nasser Ahmad
*Attorney, Agent, or Firm*—Rothwell, Figg, Ernst & Kurz, P.C.

[57] ABSTRACT

A self-adhesive label comprising a multilaminar label portion, a self-adhesive laminar material extending over and adhered by its self-adhesive surface to the multilaminar label portion and a self-adhesive support piece upon which the multilaminar label portion is disposed and to which the self-adhesive laminar material is adhered by its self-adhesive surface, the multilaminar label portion including a first folded part which is attached to the label and a second folded part which is removably attached to the first folded part.

16 Claims, 2 Drawing Sheets

LABELS

The present invention relates to a self-adhesive label.

So-called leaflet labels are known for labelling a wide variety of products when it is desired that the label has a printed area which is larger than the footprint of the label on the product. A typical leaflet label is disclosed in U.S. Pat. No. 5,399,403 issued to David J Instance. When such leaflet labels are employed to label pharmaceutical products, it is sometimes desirable or even necessary for information relating to the pharmaceutical product, for example prescribing requirements, precautions and other patient information, to be firmly retained on the product even after the label has been read by a user. It is also sometimes desired for a part of the label carrying such information to be removable so that it can be more easily read by the user remote from the product container for the convenience of the patient.

International Patent Publication No. WO98/07132 in the name of David J Instance Limited discloses a self-adhesive label having a booklet removably attached to a cover sheet which is overlaminated by a self-adhesive transparent plastics overlaminate which is in turn adhered to a self-adhesive base of the label.

It is an object of the present invention to provide a self-adhesive label which incorporates permanent and removable label parts for the convenience of the user.

Accordingly, the present invention provides a self-adhesive label comprising a multilaminar label portion, a self-adhesive laminar material extending over and adhered by its self-adhesive surface to the multilaminar label portion and a self-adhesive support piece upon which the multilaminar label portion is disposed and to which the self-adhesive laminar material is adhered by its self-adhesive surface, the multilaminar label portion including a first folded part which is attached to the label and a second folded part which is removably attached to the first folded part.

The present invention yet further provides a self-adhesive label carried on a backing of release material, the label comprising a bottom self-adhesive base, an intermediate integral inner booklet and outer booklet assembly which is disposed over the base, the inner booklet comprising a plurality of sheets which are attached together along a first spine thereof and the outer booklet surrounding the inner booklet and comprising a plurality of sheets which are attached together along a second spine thereof, the spines of the inner and outer booklets being temporarily adhered together, and an upper self-adhesive transparent plastics overlaminate which is adhered over the inner and outer booklet assembly, is adhered to a portion of the base which is laterally adjacent one edge of the inner and outer booklet assembly and is adhered to the release material laterally adjacent an opposed edge of the booklet assembly thereby to retain the label in a closed configuration.

The present invention yet further provides a self-adhesive label carried on a backing of release material, the label comprising an integral two-booklet assembly comprising a first inner folded booklet and a second outer folded booklet, with the inner folded booklet being removably adhered along a spine of the outer booklet, a folded cover sheet comprising front and rear sheets of the two-booklet assembly, the outer booklet being attached to the cover sheet, and a self-adhesive laminar material having a rear self-adhesive surface which is adhered over the cover sheet and to a backing of release material, the arrangement being such that when the laminar material is pulled away from the release material thereby to reveal the two booklet assembly, the inner booklet is detachable from the outer booklet which remains attached to the cover sheet.

An embodiment of the present invention will now be described by way of example only, with reference to the accompanying drawings, in which.

Figure 1:
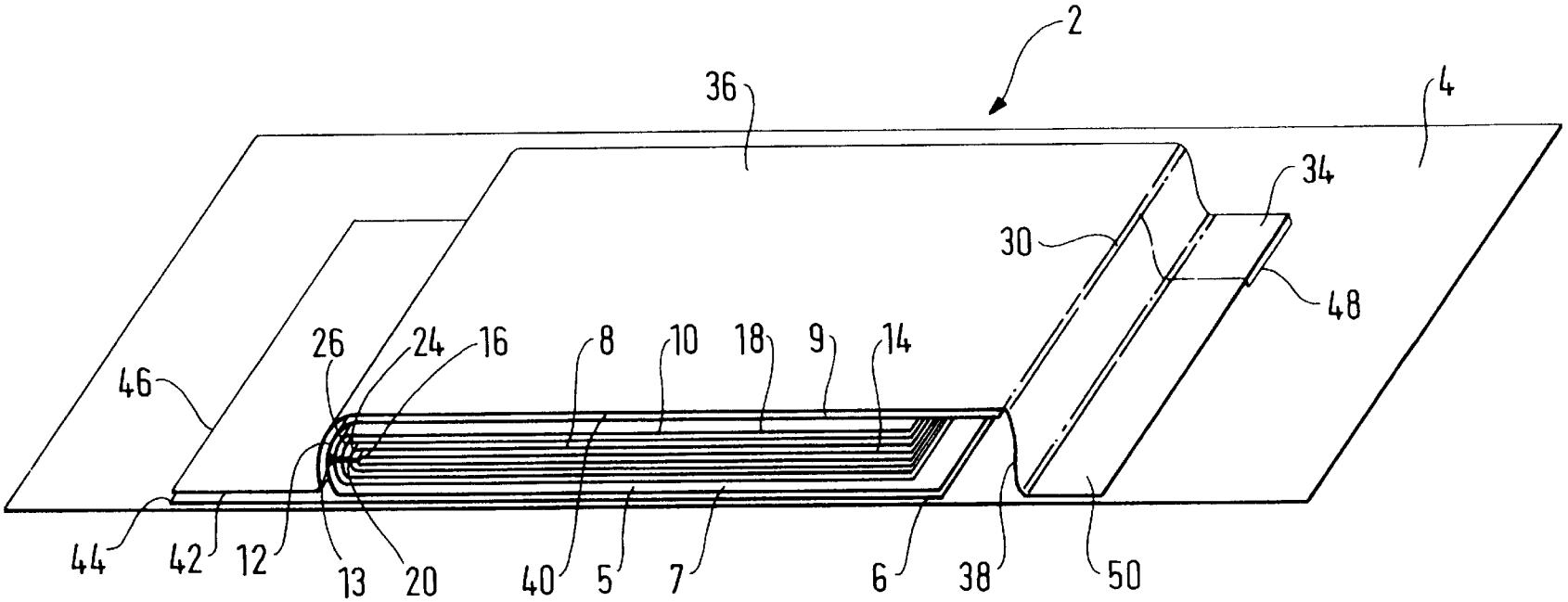
FIG. 1 is a perspective plan view of a self-adhesive label carried on a backing of release material in accordance with an embodiment of the present invention.

In the drawings, the thickness of some of the layers has been exaggerated for the purpose of clarity of illustration.

Referring to the drawings, there is shown a self-adhesive label 2 in accordance with an embodiment of the present invention when carried on a backing 4 of release material such as silicone-coated paper. Typically, a succession of such self-adhesive labels is carried on a elongate web of the backing 4 of release material and the backing 4 of release material is wound into a reel in known manner for automatic application of the labels to a succession of products or containers to be labelled by a labelling machine.

The self-adhesive label 2 comprises a self-adhesive base 6, typically of paper or plastics, which is coated on its rear surface with a layer of pressure-sensitive adhesive which is releasably adhered to the backing 4 of release material. A cover sheet 5 has a rear sheet 7 adhered to the base 6 and a front sheet 9. The cover sheet 5 is printed with information relating to the product to be labelled, preferably being printed on the front surfaces of both the front sheet 9 and the rear sheet 7. An integral double booklet assembly 8,10 is received within the cover sheet 5 and is adhered thereto along a fold 12 of the cover sheet 5 by a line, or row of dots, of adhesive 13. The double booklet assembly 8,10 comprises an inner booklet 8 and an outer booklet 10. The inner booklet 8 comprises a plurality of folded sheets 14 which are bound together by a binding 16 which in the illustrated embodiment comprises a line of adhesive. The outer booklet 10 surrounds the inner booklet 8 and also comprises a plurality of folded sheets 18 which are bound together by a binding 20 which comprises a line of adhesive.

The inner booklet 8 is removably attached to the outer booklet 10 by a removable attachment 22 which in the illustrated embodiment comprises a line, or row of dots, of adhesive 22 disposed between the outermost surface of the spine 24 of the inner booklet and the innermost surface of the spine 26 of the outer booklet 10. The outer booklet 10 is attached, either permanently or removably, to the cover 5 by the adhesive 13. When the outer booklet 10 is removably attached to the cover 5, the adhesive 13 and the adhesive 22 are selected so that the inner booklet 8 is less strongly adhered to the outer booklet 10 than the outer booklet 10 is adhered to the cover 5. The provision of such differential adhesion between the inner booklet 8, the outer booklet 10 and the cover 5 ensures that the inner booklet 8 can readily be pulled away from the outer booklet 10 without the outer booklet 10 being inadvertently removed from the cover 5. However, when thereafter it is desired to remove the outer booklet 10 from the remainder of the label, this can be achieved by pulling the outer booklet 10 away from the cover 5 using a greater force than that required to remove the inner booklet 8. The provision of the stronger attachment of the inner booklet 8 to the outer booklet 10 than the attachment of the outer booklet 10 to the cover sheet 5 as a result of a stronger adhesive bond being provided between the inner and outer booklets 8,10 than is provided between the outer booklet 10 and the cover sheet 5 can be achieved by providing different adhesive compositions with the adhesive composition for the adhesive 13 being capable of forming a stronger adhesive bond than that achievable by the adhesive 22, or by providing the same adhesive composition, but a greater amount of adhesive for the adhesive 13 than for the adhesive 22. Alternatively, differential adhesion may be achieved by coating the surfaces of the booklets 8,10 and/or the parts to which they are adhered with release coatings such as varnish, etc.

In the illustrated embodiment, the inner and outer booklets 8,10 have the same number of sheets and are printed with the same information. A front cover 27 of the booklet 8 and the front cover 9 of the cover sheet 5 each include at respective edges 28,30, thereof which are remote from the booklet spines 24,26 a respective extended tab 32,34. In the assembled configuration the tab 34 of the cover 5 overlies the tab 32 of the inner booklet 8.

A self-adhesive transparent plastics overlaminate 36 is adhered by its self-adhesive surface 38 over the front surface 40 of the cover 5, to the portion 42 of the front surface 44 of the base 6 at the transverse edge 46 of the label 2 adjacent the booklet spines 24,26, and directly to the backing 4 of release material at the opposed transverse edge 48 of the label 2 thereby forming an extended flap 50 of the overlaminate 36, which flap 50 holds the label 2 in a closed configuration. The surfaces of the booklets 8,10 are printed with information relating to the product to be labelled as is the front surface 44 of the base 6.

Figure 2:
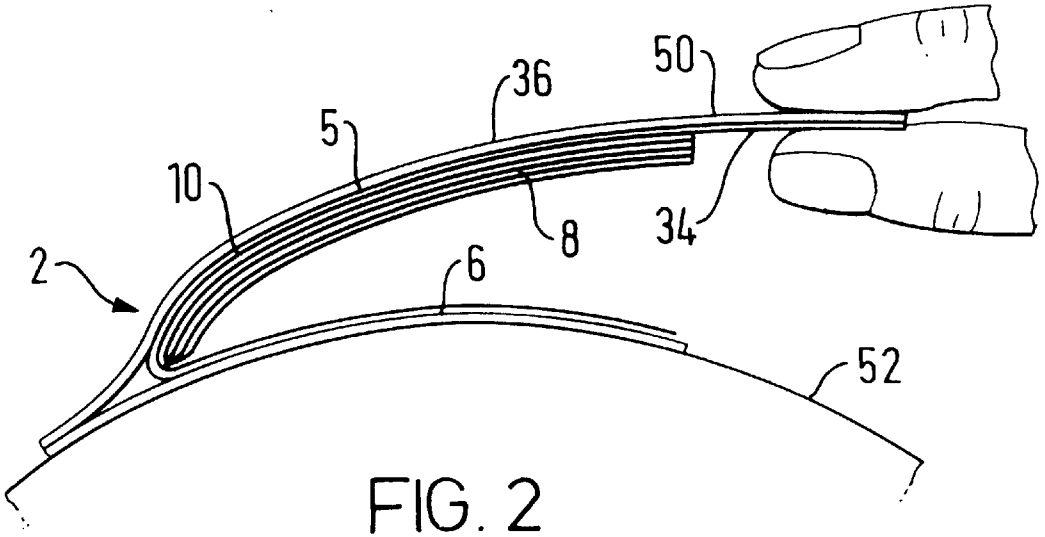
FIG. 2 is a side elevational view of the label of FIG. 1 when adhered to a product and being manually opened.

Referring now to FIG. 2, the label 2 is shown when adhered by the self-adhesive base 6 to a product 52, the product typically being a container for pharmaceuticals. In FIG. 2, the label 2 is shown in an opened configuration in which a user has manually pulled away from the container 52 the extended flap 50 of the overlaminate 36 which is adhered directly to the product 52 by pulling at the tab 34 of the cover sheet 5. Such manual opening reveals not only the outer booklet 10 but also the inner booklet 8. As discussed hereinabove, as a result of differential adhesion between on the one hand the inner booklet 8 and the outer booklet 10 and on the other hand the outer booklet 10 and the remainder of the label, in particular the cover sheet 5, the inner booklet 8 may be detached from the self-adhesive label 2, in particular from the outer booklet 10 thereof, by pulling whereby the two spines of the inner and outer booklets 8,10 are separated by tearing along the adhesive dots 22. The outer booklet 10 remains adhered to the cover sheet 5, which in turn remains adhered to the overlaminate 36. If the outer booklet 10 is temporarily attached to the cover sheet 5, the outer booklet 10 may be removed thereafter from the remainder of the self-adhesive label 2.

Figure 4:
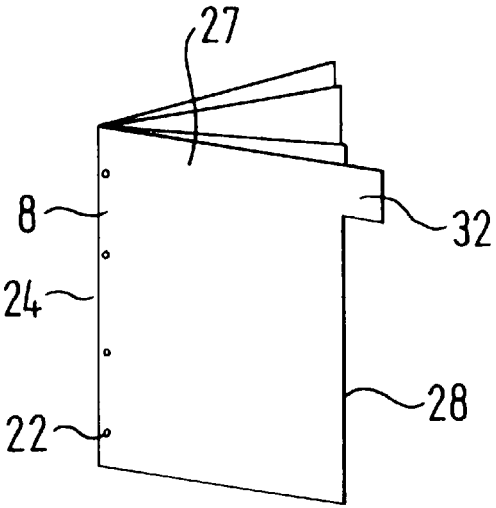
FIG. 4 is a perspective view of the inner booklet following removal from the self-adhesive label.
Figure 3:
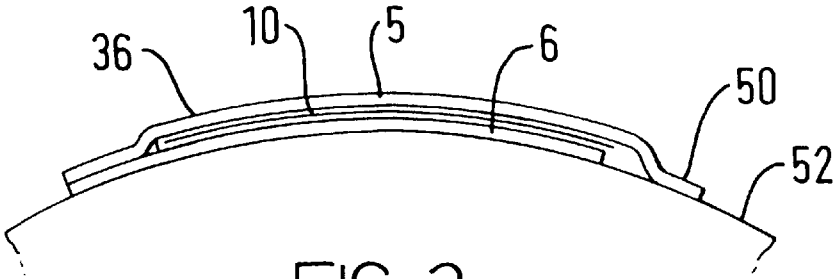
FIG. 3 is an elevational side view of the label of FIG. 2 following removal of the inner booklet of the label and re-adhesion of the laminar material to the product.

As shown in FIGS. 3 and 4, the self-adhesive label 2 having had inner booklet 8 removed therefrom may be returned to its closed configuration and its original appearance by re-adhering the extended flap 50 of the overlaminate 36 to the product 52. Thus despite the removal of the inner booklet 8, the same primary information is displayed by the label 2 in its closed configuration following removal of the inner booklet 8 because of the permanent retention of the cover sheet 5. Moreover, the information printed on the outer booklet 10 optionally remains permanently in the self-adhesive label 2 and therefore permanently attached to the pharmaceutical product 52. The outer booklet 10 can however be removable from the remainder of the label 2 as described above. The inner booklet 8 may then be read and retained by a user for convenience.

The labels may be made generally by the method disclosed in U.S. Pat. No. 5,399,403, the disclosures of which are incorporated herein by reference. Thus a succession of double booklet assemblies, each assembly containing an inner booklet removably adhered within an outer booklet, with the booklets being adhered within a cover sheet, is applied to a succession of pre die-cut self-adhesive labels carried on a release backing material. A web of self-adhesive overlaminate is laminated thereover and the required labels are formed by die-cutting through the overlaminate, the assemblies, and the bases as far as the release backing material. The waste matrix is then stripped from the release material leaving a succession of labels of the invention on the length of release material which is then wound into a reel.

The self-adhesive label of the present invention has a number of technical advantages over known labels. In the label of the present invention, two substantially identical booklets are securely held within the label without the user being aware of the presence of two booklets therein prior to opening of the label. Following opening of the label, the inner booklet can be removed from the label for the convenience of the patient, yet the other booklet remains permanently adhered to the remainder of the label and to the product for security reasons so that if the removed label is lost the prescribed information always remains adhered to the pharmaceutical product. The label of the present invention is an elegant solution to the problem of providing the combination of permanent and removable information in a leaflet label particularly for labelling pharmaceutical products.

It will be apparent to those skilled in the art that a number of modifications may be made to the self-adhesive labels disclosed herein without departing from the present invention. For example, the inner and outer booklets need not be identical. Moreover, the inner and outer booklets may be detachably adhered together at a position other than along coincident spines thereof. The cover sheet may be omitted.

What is claimed is:

1. A self-adhesive label comprising a multilaminar label portion, a self-adhesive laminar material extending over and adhered by its self-adhesive surface to the multilaminar label portion and a self-adhesive support piece upon which the multilaminar label portion is disposed and to which the self-adhesive laminar material is adhered by its self-adhesive surface, the multilaminar label portion including a first folded part, a second folded part which is removably attached to the first folded part, and a printed cover which covers the first and second folded parts and to which the first folded part is attached, wherein the first folded part is more strongly attached to the printed cover than the second folded part is attached to the first folded part.

2. A self-adhesive label according to claim 1 wherein the first and second folded parts are booklets.

3. A self-adhesive label according to claim 1 wherein the second folded part is received within the first folded part.

4. A self-adhesive label according to claim 1 wherein the first folded part is permanently attached to the label.

5. A self-adhesive label according to claim 1 wherein the first folded part is removably attached to the label.

6. A self-adhesive label according to claim 1 wherein the second folded part is temporarily adhered to the first folded part by a first portion of adhesive and the first folded part is temporarily adhered to the printed cover by a second portion of adhesive, the second portion of adhesive having a stronger adhesive bond than the first portion of adhesive.

7. A self-adhesive label according to claim 6 wherein the first portion of adhesive is disposed along adjacent spines of the first and second folded parts.

8. A self-adhesive label according to claim 6 wherein the second portion of adhesive is disposed along an outer surface of a spine of the first folded part.

9. A self-adhesive label carried on a backing of release material, the label comprising a bottom self-adhesive base, an intermediate integral inner booklet and outer booklet assembly which is disposed over the base, the inner booklet comprising a plurality of sheets which are attached together along a first spine thereof and the outer booklet surrounding the inner booklet and comprising a plurality of sheets which are attached together along a second spine thereof, the spines of the inner and outer booklets being temporarily adhered together, a printed cover for the booklet assembly to which the outer booklet is attached, and upper self-adhesive transparent plastics overlaminate which is adhered over the inner and outer booklet assembly, is adhered to a portion of the base which is laterally adjacent one edge of the inner and outer booklet assembly and is adhered to the release material laterally adjacent an opposed edge of the booklet assembly thereby to retain the label in a closed configuration, wherein the outer booklet is more strongly adhered to the cover sheet than the inner booklet is adhered to the outer booklet.

10. A self-adhesive label according to claim 9 wherein the outer booklet is removably attached to the cover.

11. A self-adhesive label according to claim 10 wherein the outer booklet is adhered to the cover by a first portion of adhesive.

12. A self-adhesive label according to claim 11 wherein the spines of the inner and outer booklets are adhered together by a second portion of adhesive.

13. A self-adhesive label carried on a backing of release material, the label comprising an integral two-booklet assembly comprising a first inner folded booklet and a second outer folded booklet, with the inner folded booklet being removably adhered along a spine of the outer booklet, a folded cover sheet comprising front and rear sheets of the two-booklet assembly, the outer booklet being attached to the cover sheet more strongly than the inner folded booklet is adhered to the outer booklet, and a self-adhesive laminar material having a rear self-adhesive surface which is adhered over the cover sheet and to a backing of release material, the arrangement being such that when the laminar material is pulled away from the release material thereby to reveal the two booklet assembly, the inner booklet is detachable from the outer booklet which remains attached to the cover sheet.

14. A self-adhesive label according to claim 13 wherein the spines of the inner and outer booklets are adhered together by a first portion of adhesive.

15. A self-adhesive label according to claim 14 wherein the outer brooklet is detachable from the cover sheet.

16. A self-adhesive label according to claim 15 wherein the outer booklet is adhered to the cover sheet by a second portion of adhesive which forms a stronger adhesive bond therebetween than the adhesive bond of the first portion of adhesive between the inner and outer booklets.

* * * * *